US007246508B1

(12) United States Patent
Lo

(10) Patent No.: US 7,246,508 B1
(45) Date of Patent: Jul. 24, 2007

(54) AUTOMATIC COLLAR STAY INSERTION DEVICE

(76) Inventor: Yi-Xin Lo, No. 38-1, Lane 9, Kao Cheng 1st St., Pa Te City, Taoyuan Hsien (TW)

( * ) Notice: Subject to any disclaimer, the term of this patent is extended or adjusted under 35 U.S.C. 154(b) by 0 days.

(21) Appl. No.: 11/561,894

(22) Filed: Nov. 21, 2006

(51) Int. Cl.
*D04B 37/00* (2006.01)

(52) U.S. Cl. ..... 66/61; 223/27

(58) Field of Classification Search ..... 66/61, 66/60 R, 1 R, 147; 223/1, 4, 27
See application file for complete search history.

(56) References Cited

U.S. PATENT DOCUMENTS 713,247 A * 11/1902 Shepard ..... 223/4
2,875,928 A * 3/1959 Cohen ..... 223/2
3,191,557 A * 6/1965 Moore ..... 112/470.05
4,026,749 A * 5/1977 Appelhans et al. ..... 156/252
4,093,498 A * 6/1978 Wendell ..... 156/494
4,169,753 A * 10/1979 Wendell ..... 156/160
4,213,547 A * 7/1980 Conner, Jr. ..... 223/2
4,286,337 A * 9/1981 Malouf, Jr. ..... 2/116
5,022,239 A * 6/1991 Kitazawa ..... 66/127
5,261,992 A * 11/1993 Moll ..... 156/308.2
7,051,376 B2 * 5/2006 Friedman ..... 2/132

* cited by examiner

*Primary Examiner*—Danny Worrell
(74) *Attorney, Agent, or Firm*—Leong C. Lei

(57) ABSTRACT

An automatic collar stay insertion device is provided herein. The device is for automatically inserting the collar stay. The device is mounted in a flat knitting machine utilizing motors and gears to rotate, locate and supply the collar stay. The conventional human involvement of inserting the collar stay is replaced by the automatic collar stay insertion device of the invention to decrease the costs and increase the product efficiency.

3 Claims, 8 Drawing Sheets

AUTOMATIC COLLAR STAY INSERTION DEVICE

BACKGROUND OF THE INVENTION (a) Technical Field of the Invention

The present invention generally relates to means for inserting collar stay into a shirt collar, and more particularly to an automatic collar stay insertion device for a flat knitting machine.

(b) Description of the Prior Art

As technology advances, the manufacturing processes of the textile industry are pretty much automated so as to reduce production cost and to increase the production capacity.

During the making of a shirt, despite that most of the work is carried out without human labor, the placement of the collar stays inside the spread collar of the shirt at the positions shown in FIG. 1, at the present time, still requires human involvement, which significantly limits the production efficiency of the shirts.

SUMMARY OF THE INVENTION

The primary purpose of the present invention is to provide an automatic collar stay insertion device, which comprises a static member, a positioning member, and a collar stay supply member. The static member is mounted on a flat knitting machine. The other two parts are driven by motors. The positioning member utilizes the gears to rotate and move the moving plate. The sensor detects the detecting plate on the moving plate to control the position of the moving plate. The groove on the moving plate is then aligned with the place where the collar stay is to be inserted. The collar stay supply member utilizes a bevel gear to transport the power to the post with threaded so that the moving base on the post with threaded is moved therewith. The pushing post then pushes the collar stay in the collar stay case toward the place where the collar stay is to be inserted. The flat knitting machine with the automatic collar stay insertion device of the invention is automatically inserting a collar stay into a shirt collar through editing computer program.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawing in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

An automatic collar stay insertion device of the present invention mainly comprises a static member, a positioning member, and a collar stay supply member.

Figure 1:
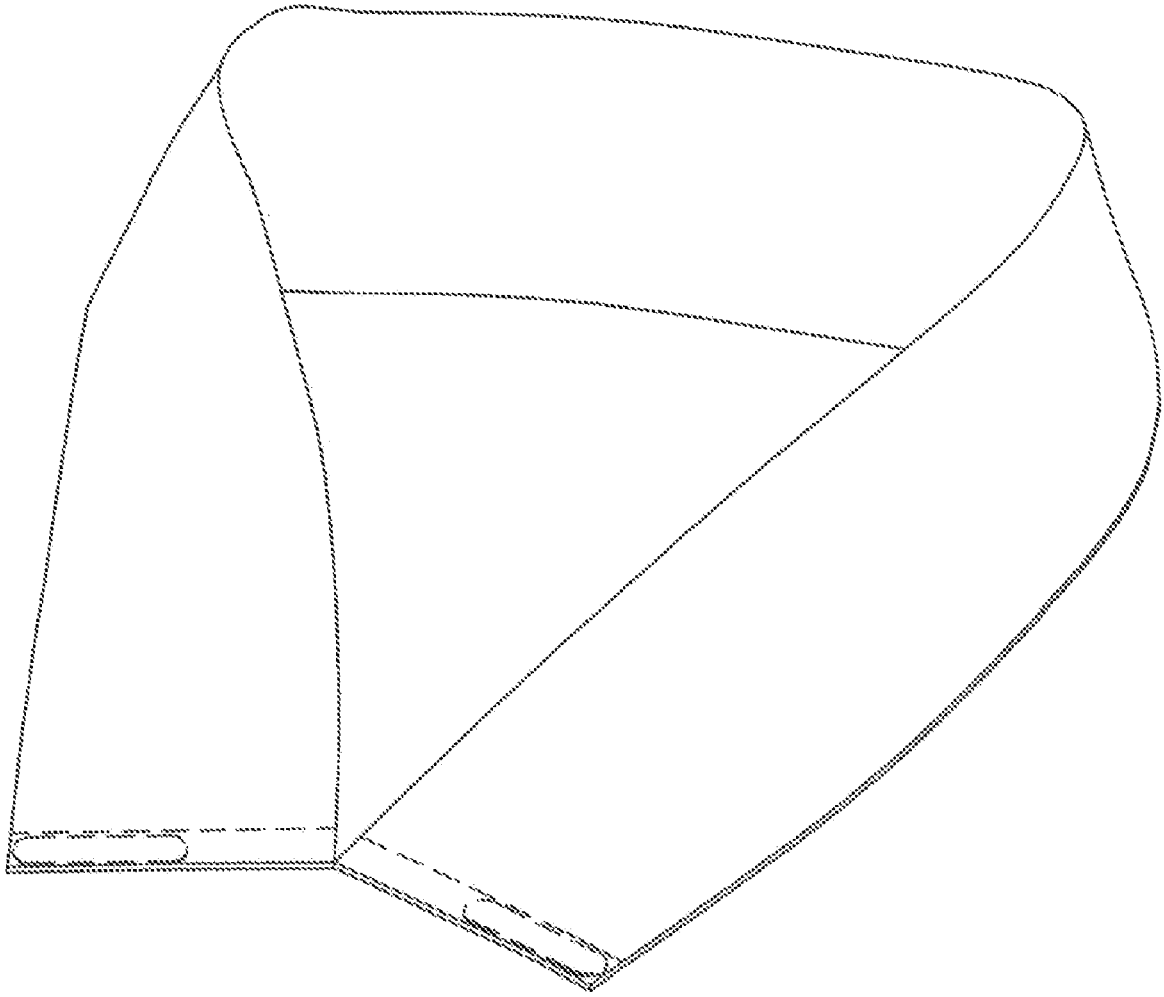
PRIOR ART FIG. 1
FIG. 1 is a schematic view of a conventional device.
Figure 2:
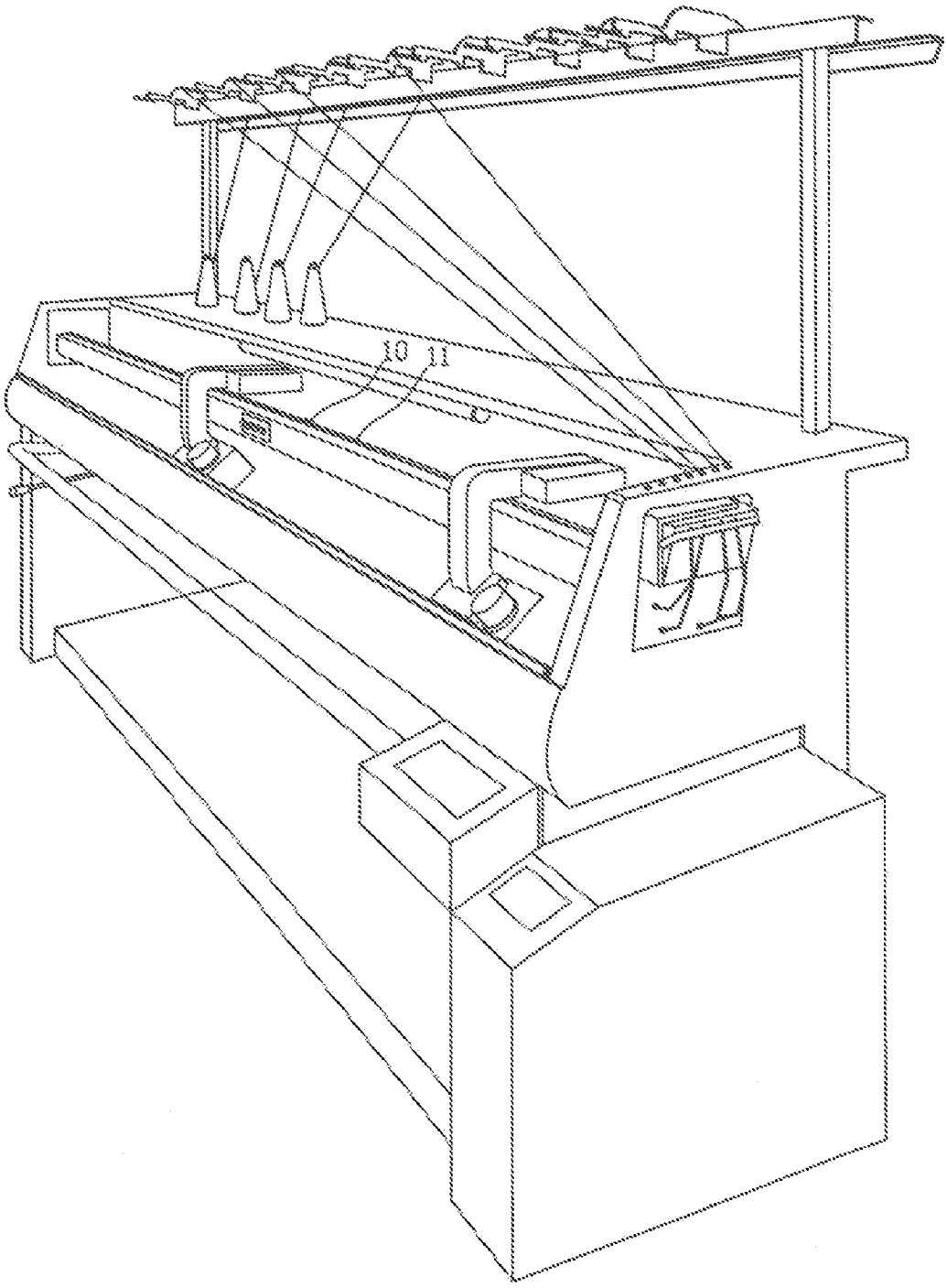
FIG. 2 is a perspective view of a device of the invention.
Figure 3:
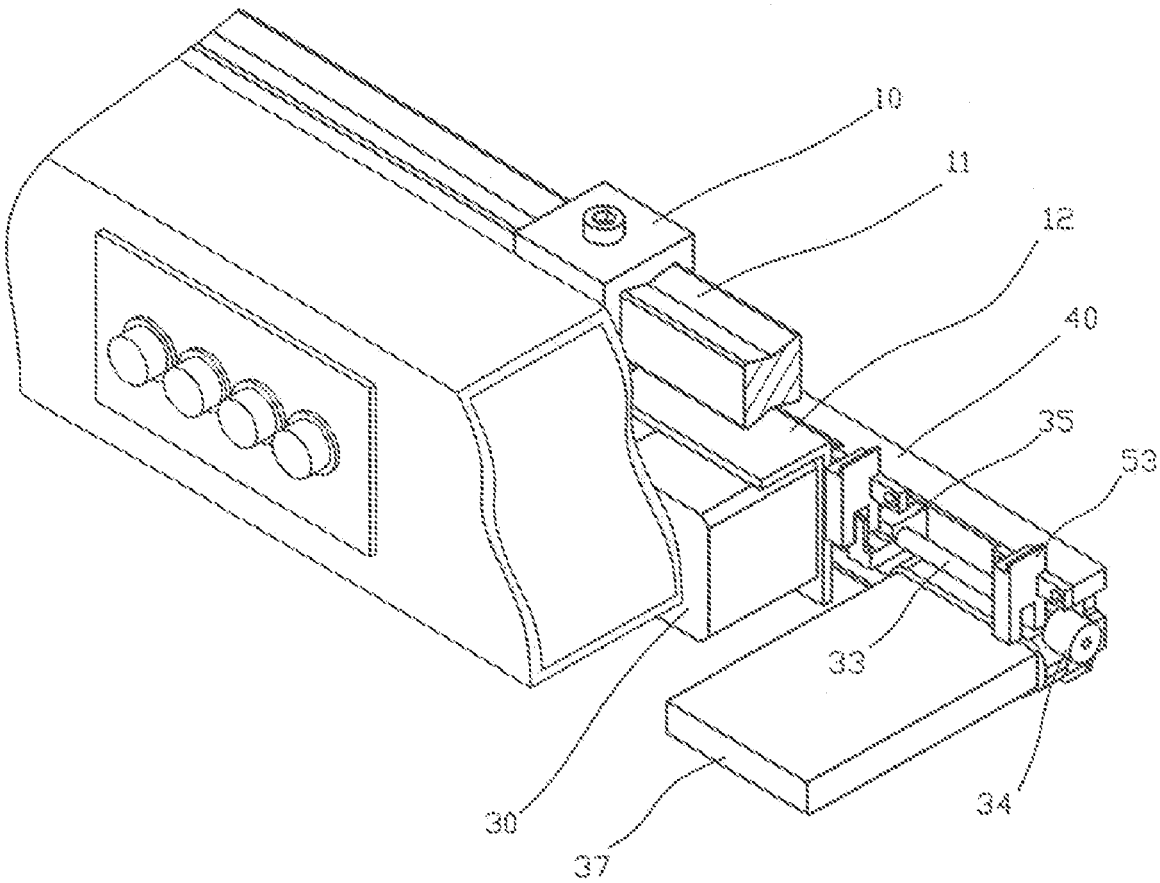
FIG. 3 is perspective view of a device of the invention.
Figure 4:
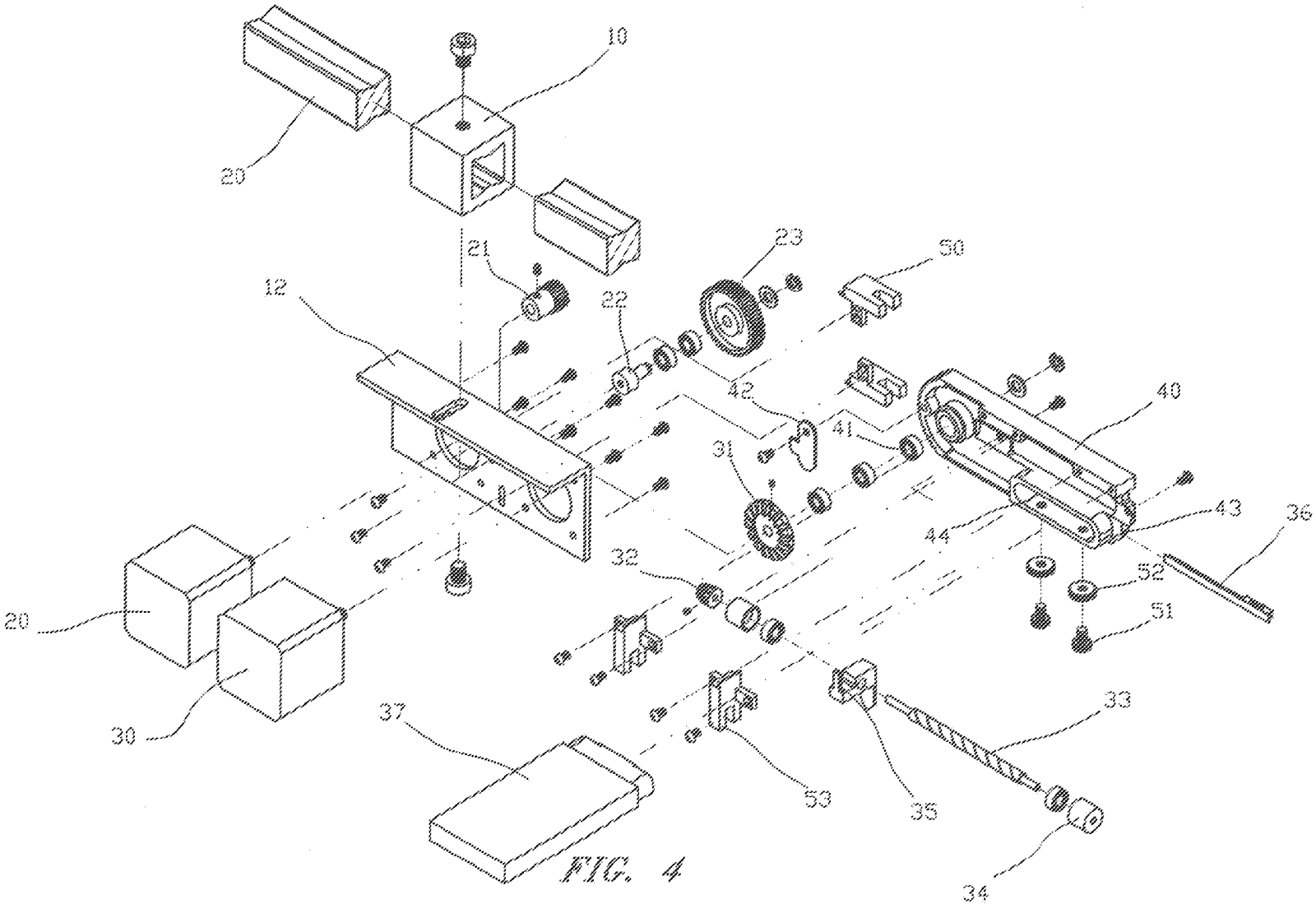
FIG. 4 is a schematic view of a device of an embodiment of the invention.
Figure 5:
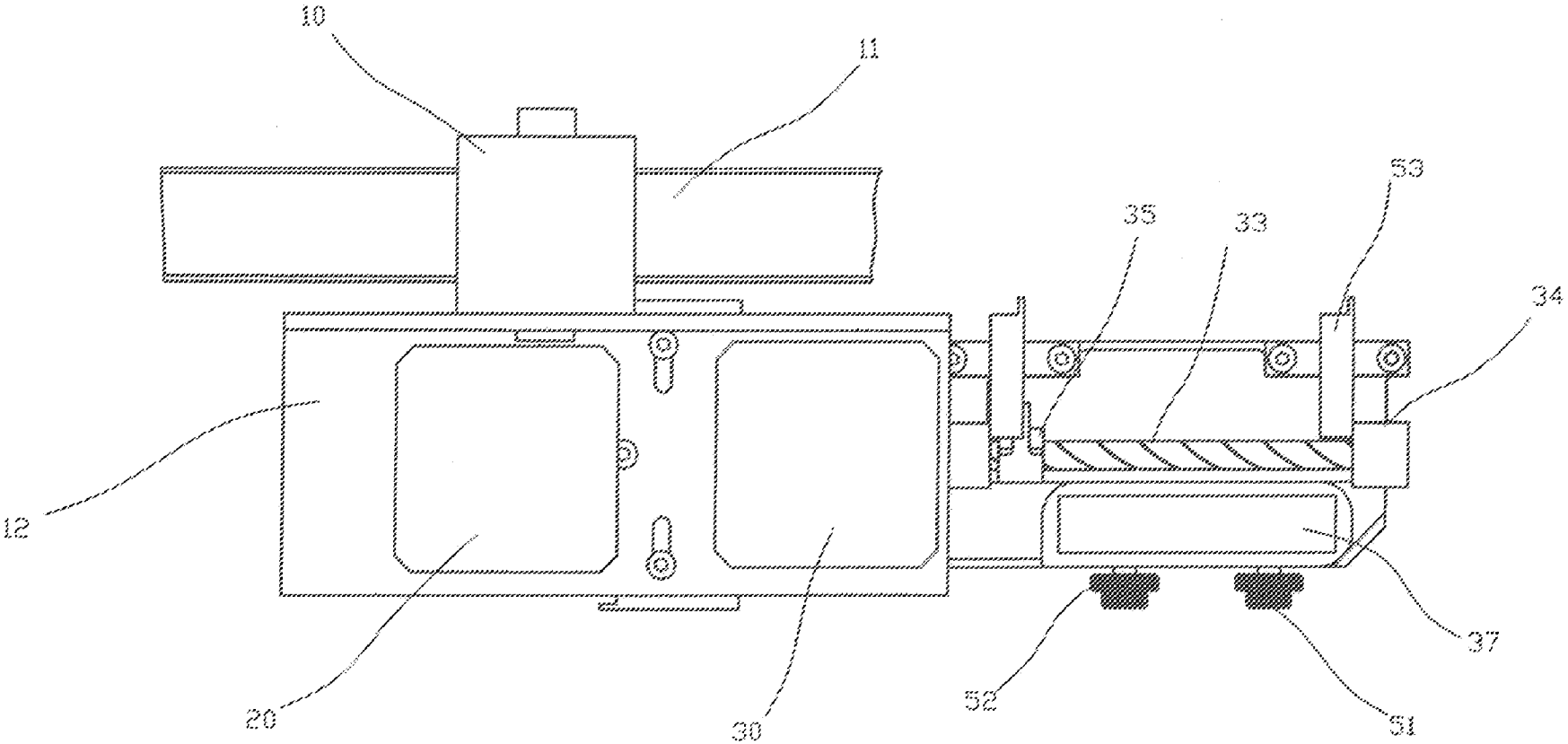
FIG. 5 is a schematic view of a device of an embodiment of the invention.
Figure 6:
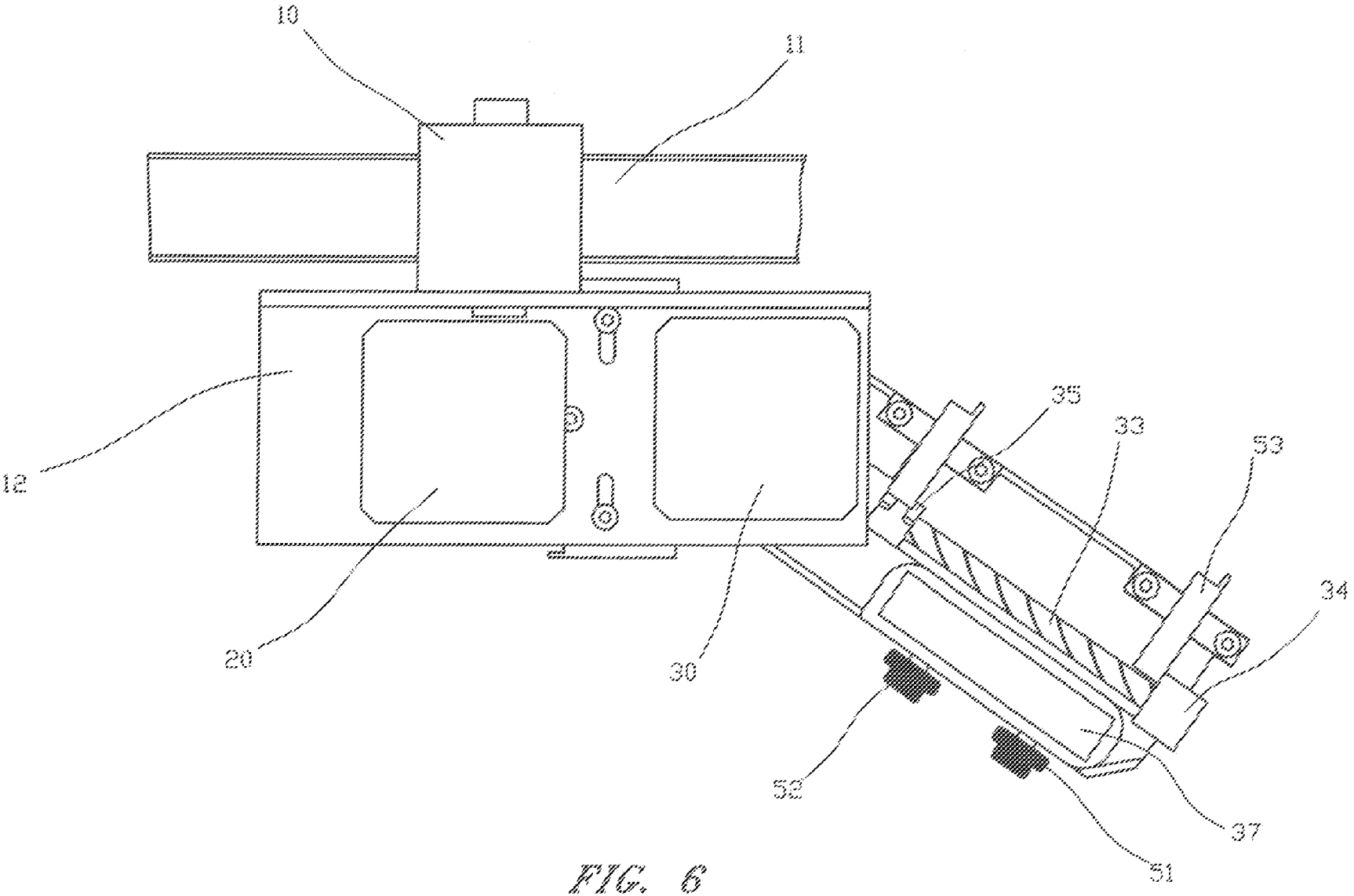
FIG. 6 is a schematic view of a device of an embodiment of the invention.
Figure 7:
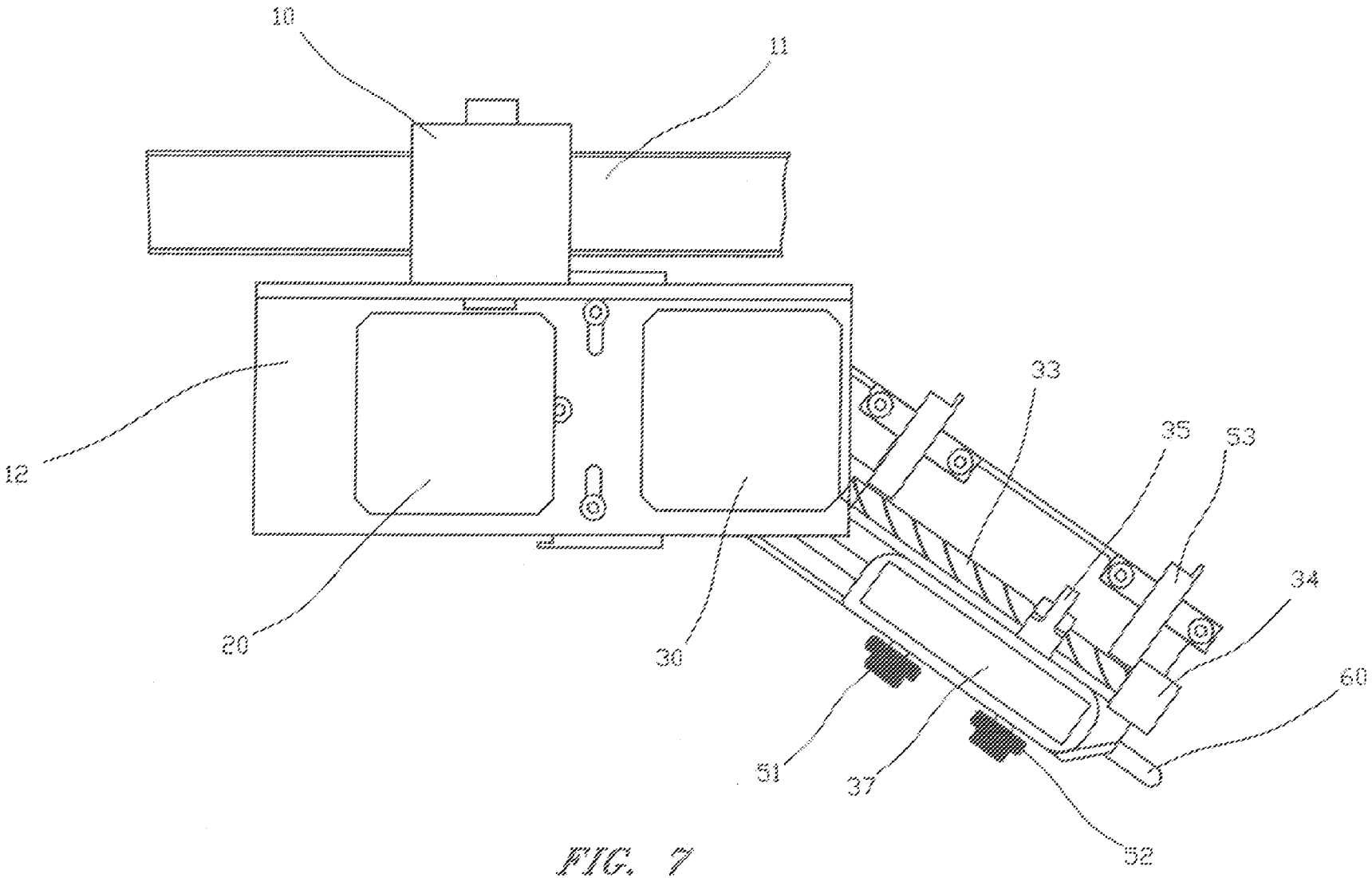
FIG. 7 is a schematic view of a device of an embodiment of the invention.
Figure 8:
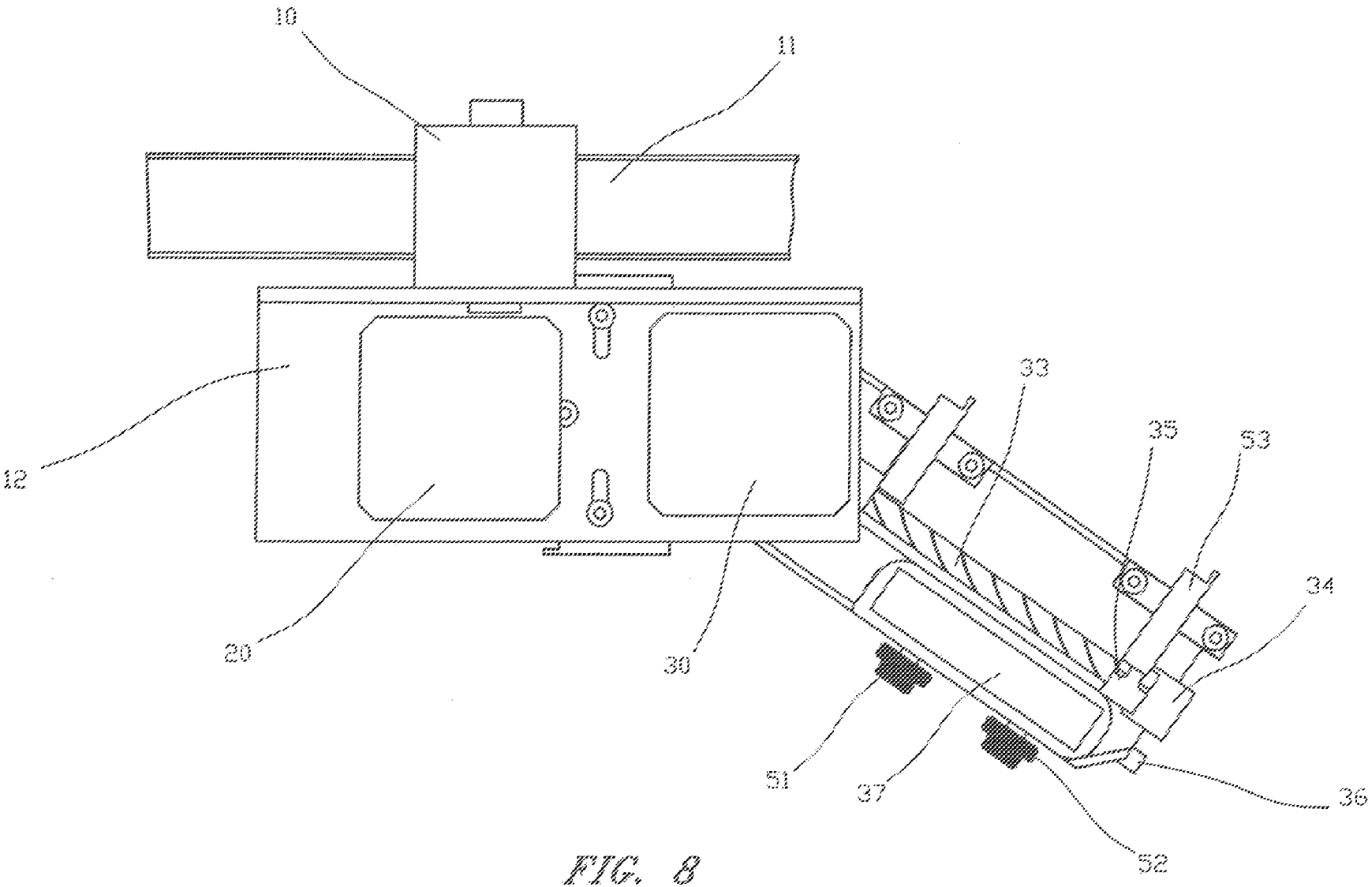
FIG. 8 is a schematic view of a device of an embodiment of the invention.

For an embodiment of the automatic collar stay insertion device as shown in FIGS. 2 to 4, the static member comprises a block 10 slidably mounted around a horizontal rail 11 of a flat knitting machine so that the block 10 can be slid along the horizontal rail 11 to an appropriate position. The block 10 is then fixed at the position by fastening two bolts through two threaded holes on the top and bottom surfaces of the block 10, respectively, against the horizontal rail 11. An L-shape plate 12 for the positioning member and the collar stay supply member is fixed on the block 10.

The positioning member and the collar stay supply member are fixed on the L-shape plate 12. Two motors 20 and 30 are mounted on the L-shape plate 12. The positioning member utilizes a gear 21 to connect to a shaft of the motor 20. The gear 21 drives an assisting gear 23 disposed on the assisting shaft 22. The assisting gear 23 engages the rack at an end of the moving plate 40 so that the moving plate 40 connects to the motor 30 is rotatable therewith. Due to the moving plate 40 is disposed between the motor shafts by bearing 41, the motor 30 rotates without affecting the moving plate 40. The moving plate 40 is rotatable to move or to position via a detecting plate 42 screwed thereon and a sensor 50 fixed on the L-shape plate 12 for controlling the motor.

The collar stay supply member utilizes a bevel driving gear 31 to connect to a shaft of the motor 30. The bevel driving gear 31 is disposed between the motor 30 and the moving plate 40 and cooperates with a bevel driven gear 32 disposed at an end of a post with threaded 33. The post with threaded 33 and the sleeve 34 are fixed on the moving plate 40 by screw. A moving base 35 is slidably disposed on the post with threaded 33. A side edge of the moving base 35 plugs into a square opening of a guiding groove 43 with a pushing post 36 therein. When motor drives the gears and the post with threaded 33, the moving base 35 moves therewith. The pushing post 36 is then moved with the moving base 35. The collar stay case 37 is disposed in the groove 44 of the moving plate 40 by screws 51 and connectors 52. The slot on the collar stay case 37 engages to the guiding groove 43 so that the collar stay 60 in the collar stay case 37 is pushed out of the guiding groove 43 while the pushing post 36 moves in the guiding groove 43. The sensor 53 on the moving plate 40 detects the position of the moving base 35 on the post with threaded 33 to control the movement of the pushing post 36.

Referring to FIG. 5 to FIG. 8, the automatic collar stay insertion device of the invention is installed in a flat knitting machine and is programmed by digital computer program. When knitted, the flat knitting machine is temporary stopped at the position inserting the collar stay. The motor 20 is then driven and the gears are cooperated with each other. The sensor 50 detects the position of the detecting plate 42 of the moving plate 40. The moving plate 40 is then rotated so that the guiding groove 43 on the moving plate 40 aligns with the place where the collar stay is inserted.

The motor 30 drives the bevel gears to transport the power to the post with threaded 33, thereby moves the moving plate 35 on the post with threaded 33 and the pushing post 36 so that the collar stay in the collar stay case 37 is pushed toward the place where the collar stay is inserted from the groove. The sensor 53 on the moving plate 40 detects the position of the moving base 35. The motor 30 is then operated counter to move the moving base 35 and the pushing post 36 in opposite direction. The other sensor on the moving plate 40 is actuated. When the sensor detects the position on the moving base 35, the motor 30 is stop and the moving base 35 and the pushing post 36 move back to the original position. The motor 20 is then operated counter to move the moving plate 40 back to the original position by the gears and the detecting plate 42. As mentioned, the automatic knitting process of the flat knitting machine is completed.

In sum, the collar stay insertion device of the invention is utilized in a flat knitting machine with automatic processing. The motors and the gears are used to rotate, position, and supply the collar stay. A plurality of collar stay insertion devices may install in one flat knitting machine to increase efficiency.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An automatic collar stay insertion device, comprising:

a static member comprising a block disposed on a rail;

an L-shape plate fixed on the block;

a positioning member fixed on the L-shape plate and electrically connected to a motor;

a moving plate, wherein the positioning member engages an end of the moving plate via a gear and an assisting gear;

a detecting plate, wherein the moving plate is screwed thereon;

a sensor disposed on the L-shape plate, wherein the detecting plate and the sensor are cooperated to control the movement of the moving plate;

a collar stay supply member electrically connected to a motor and comprising a pushing post;

a moving base;

a post with threaded, wherein the moving base is slidably disposed thereon via a bevel driving gear connect to a shaft of the motor and a bevel driven gear, and a side edge of the moving base plugs into a square opening of a guiding groove with a pushing post 36 therein;

a collar stay case having a plurality of collar stays, disposed in a groove of the moving plate, and fixed by screws and connectors, and a slot on the collar stay case engages to the guiding groove;

wherein the guiding groove on the moving plate aligns with a place where the collar stay is inserted, the pushing post pushes the plurality of collar stays from the collar stay case to the place.

2. The automatic collar stay insertion device according to claim 1, wherein the automatic collar stay insertion device is cooperated with a flat knitting machine.

3. The automatic collar stay insertion device according to claim 1, wherein at least one automatic collar stay insertion device is installed in a flat knitting machine.

* * * * *